US006132079A

United States Patent [19]

King

[11] Patent Number: 6,132,079

[45] Date of Patent: Oct. 17, 2000

[54] MULTI PATH MIXING APPARATUS

[75] Inventor: Leonard Tony King, Long Bch, Calif.

[73] Assignee: Komax Systems, Inc., Wilmington, Calif.

[21] Appl. No.: 09/175,926

[22] Filed: Oct. 20, 1998

Related U.S. Application Data

[63] Continuation-in-part of application No. 08/806,784, Feb. 26, 1997, abandoned.

[51] Int. Cl.[7] ..... B01F 15/02; B01F 5/00

[52] U.S. Cl. ..... 366/181.5; 366/181.6; 366/175.2; 366/336

[58] Field of Search ..... 366/181.5, 336, 366/337, 338, 339, 340, 178.1, 178.2, 181.6, 173.1, 173.2, 167.1, 174.1, 175.2; 152/109.1

[56] References Cited

U.S. PATENT DOCUMENTS

| | | | |
|---|---|---|---|
| 1,448,151 | 3/1923 | Reeves | 366/336 |
| 2,815,532 | 12/1957 | Braunlich | 366/336 |
| 3,064,680 | 11/1962 | Winslow, Jr. | 366/340 |
| 3,232,590 | 2/1966 | Eckert | 366/336 |
| 4,382,684 | 5/1983 | Hori | 366/181.5 |
| 4,808,007 | 2/1989 | King | 366/336 |
| 5,388,906 | 2/1995 | Rao | 366/336 |

FOREIGN PATENT DOCUMENTS

| | | | |
|---|---|---|---|
| 581 493 | 11/1976 | Switzerland | 366/181.5 |
| 111 802 | 9/1984 | U.S.S.R. | 366/336 |

OTHER PUBLICATIONS

Derwent Abstract SU 1111–802–A, Sep. 1984.

*Primary Examiner*—Tony G. Soohoo
*Attorney, Agent, or Firm*—Malcolm B. Wittenberg

[57] ABSTRACT

A stationary material mixing apparatus located within a conduit for mixing a low viscosity additive into a high viscosity moving stream. The apparatus includes a baffle which supports a plurality of coplanar passageways and, at mid-circle points between the passageways, a plurality of coplanar additive fluid ports.

15 Claims, 5 Drawing Sheets

MULTI PATH MIXING APPARATUS

RELATED APPLICATIONS

The present application is a continuation-in-part of U.S. patent application Ser. No. 08/806,784, filed Feb. 26, 1997, abandoned.

TECHNICAL FIELD OF THE INVENTION

The present invention deals with a material mixing apparatus which is static in nature, meaning that the apparatus contains no moving parts. The mixer of the present invention is uniquely designed to enhance the mixing of a low viscosity component such as a colorant or dye into a high viscosity fluid stream such as a polymer melt.

BACKGROUND OF THE INVENTION

It is common practice to mix particulate solids, liquids and gases with motionless mixers having, as the name implies, no moving parts. Mixers of this category consist of baffles of various types arranged sequentially in a tube or pipe. By a process of division and recombination, separate input components can be mixed or dispersed within one another at the output of said tube or pipe.

Difficulties are often experienced, however, when mixing materials of widely disparate viscosities and/or very different flow rates. For example, in the polymer field, it is at times desirable to mix very small quantities of a low viscosity material within a much larger quantity of a high viscosity material. When this is done, the low viscosity material tends to tunnel through the mixing elements without blending with the high viscosity material to any great extent. As an example, one might wish to mix a stream flowing at a rate of 7 gpm of a polymer having a viscosity of 30 million centipoises with a second stream traveling at 0.035 gpm of 6 centipoise material.

A variety of approaches have been attempted to produce an initial degree of dispersion or mixing at the injection point of the low viscosity material. These approaches have included, by way of illustration, the use of a multiplicity of injection ports around the circumference of a pipe. A second approach has consisted of the use of a relatively small diameter pipe for carrying the low viscosity material which passes through the diameter of the main pipe carrying the high viscosity material. The small diameter pipe is configured to have a plurality of holes used for injecting the low viscosity fluid. A common problem of such devices having parallel path outlets is that the low viscosity fluid injection apertures become differentially plugged resulting in asymmetric distribution.

It is well known that one of the mechanisms that allows for mixing of fluids is diffusion. However, when dealing with high viscosity materials which typically produce laminar flow, diffusion rates are very small. It is known that the rate of mass transfer N of the diffusing component measured in moles per second per unit area is equal to the diffusivity D multiplied by the local concentration gradient $$\frac{dC}{dr}.$$

Thus, $$N \alpha D \frac{dC}{dr}$$

Since D is small in high viscosity material, it is necessary to make the concentration gradient $$\frac{dC}{dr}$$

large in order to maximize the value of the mass transfer rate N.

It is thus an object of the present invention to provide a motionless mixing device without the drawbacks of corresponding devices of the prior art.

It is yet another object of the present invention to present a motionless mixing device particularly useful in the mixing of two or more fluids having widely disparate viscosities.

It is yet another object of the present invention to present a motionless mixing device which maximizes the rate of mass transfer N to improve diffusion between the fluids to be mixed.

Referring again to the equation presented above, the rate of mass transfer N can be increased by decreasing dr. In principle, this can be accomplished by placing a relatively small diameter pipe across the diameter of a larger pipe or tube, the small diameter pipe having a thin slot along its length. The fluid component exiting the slot would be introduced in the form of very thin sheets, but the clogging problems discussed above would nevertheless plague this approach.

These problems were addressed in applicant's U.S. Pat. No. 4,808,007 filed on Aug. 27, 1987, the subject matter of which is shown in FIG. 1 appended hereto. As noted, the mixing device comprises a hollow tubular member 1 which is constricted at 9, said constriction comprising, for example, two orifices 5, 6 for passage of a relatively high viscosity fluid. As such, it is noted that applicant has taught an approved mixing device whereby at least two orifices which are preferably substantially cylindrical and whose axes are substantially parallel are shown as carrying a first fluid whereby a fluid entry port discharging a second fluid substantially between the two orifices at or near their points of tangency represents a mixing device superior to those which preceded it at least for the introduction of a low viscosity fluid into a mass flow of high viscosity materials.

Again, referring to FIG. 1, low viscosity fluid entry port 15 is shown to comprise an orifice located in hollow tube 20 which is shown radially extending through the sidewalls of an elongated hollow tubular member 1. The low viscosity fluid is caused to enter the motionless mixer through the hollow tube and its rate of discharge is controllable by pumping means (not shown).

As applicant has taught, hollow tube 20 passes radially through tubular member 1 through the center points of each orifice 5 and 6. Without orifices 5 and 6, low viscosity fluid entering a high viscosity fluid stream through entry port 15 would simply form a thin line stream as the fluids pass through hollow tubular member 1. By practicing the invention disclosed in applicant's U.S. Pat. No. 4,808,007, it was surprisingly determined that the low viscosity fluid 20 forms an elongated flat plane across the diameter of the pipe which greatly enhanced molecular diffusion between the low viscosity and high viscosity fluids. This increased the surface area available for diffusion by a factor typically 25 to 50 times while at the same time increasing the value of $$\frac{dC}{dr}.$$

Apparatus, such as that shown in FIG. 1, has been successfully used to introduce and mix a relatively small amount of an additive into a viscous main product such as a thermoplastic polymer melt. Such melts have viscosities typically in a range of 50,000 to 10,000,000 centipoise. Additives can be colorants, lubricants, tackifiers and catalysts and, often, have viscosities much lower than the main product, for example, in the range of 1 to 1,000 centipoise. Low viscosity additives are commonly introduced at a rate of approximately 0.1% to 1% of the rate of the main product flow. Mixers such as those shown in FIG. 1 are generally used when it is necessary to accomplish the mixing task in a continuous or in-line fashion using static or motionless mixing devices since these are generally less expensive to install and maintain than mechanically driven mixing equipment. However, when additive viscosity and flow rate is small compared to the main flow, the number of static mixing elements must be increased to achieve an acceptable quantity of mixing. Although the device shown in FIG. 1 has adequately performed in the field, it has now been recognized that a more efficient means of mixing would be advantageous. Specifically, when mixing components which quickly react to one another upon contact, it has long been thought to be desirable to construct a motionless mixing apparatus which is capable of premixing components prior to their physical contact so that some degree of mixing is achieved before any reaction takes place.

These and further objects will be more readily appreciated when considering the following disclosure and appended claims.

SUMMARY OF THE INVENTION

Briefly stated, a stationary material mixing apparatus is located within a conduit for mixing a low viscosity additive into a high viscosity moving stream. The apparatus includes a baffle which supports a plurality of coplanar passageways and, at mid-circle points between the passageways, a plurality of low viscosity additive fluid ports.

The present invention is directed to a stationary material mixing apparatus located within a conduit having a length, cross-section and longitudinal axis. The stationary material mixing apparatus is ideally suited for mixing a relatively small quantity of additive fluid to a main fluid flowing within the conduit. The stationary material mixing apparatus includes a baffle extending throughout the conduit cross-section. A plurality of coplanar passageways extends through the baffle, the plurality of coplanar passageways may include a central passageway and a array of passageways concentric with the central passageway. Each passageway has a substantially circular cross-section that is substantially equal in diameter to the substantially circular cross-section of an adjacent passageway. Each passageway also has a longitudinal axis that is substantially parallel to the longitudinal axis of the conduit. The substantially circular cross-section of each passageway defines mid-circle points with the substantially circular cross-sections of adjacent passageways and the central passageway (if present). A plurality of additive fluid ports coplanar with said passageways extend into the baffle with each additive fluid port being located at one of the mid-circle points. A fluid path is established within the baffle for feeding the additive fluid to the plurality of additive fluid ports for mixing with the main fluid flowing within the conduit.

The present invention can be employed to carry out a method of mixing a low viscosity additive fluid into a high viscosity main fluid flowing within a conduit, the conduit having a length, cross-section and a longitudinal axis. The method includes the steps of providing a baffle that extends across the cross-section of the conduit and providing a plurality of coplanar passageways that extend through the baffle. The plurality of coplanar passageways may include a central passageway and an array of coplanar passageways concentric with the central passageway. Each passageway has a substantially circular cross-section and a longitudinal axis that is substantially parallel to the longitudinal axis of the conduit. The method also includes the step of arranging the plurality of coplanar passageways so that mid-circle points are established between adjacent passageways. The method further includes the steps of providing a plurality of additive fluid ports that extend into the baffle, arranging the additive fluid ports so that an additive fluid port is located at each mid-circle point, and establishing a fluid path within the baffle for feeding additive fluid to the additive fluid ports.

BRIEF DESCRIPTION OF THE DRAWINGS

The present invention, together with its various features and advantages, can be readily understood from the following more detailed description presented in conjunction with the following drawings, in which.

DETAILED DESCRIPTION OF THE INVENTION

As noted previously, in many industrial situations, it is necessary to introduce and mix a relatively small amount of an additive into a viscous main product such as a thermoplastic polymer melt. Such melts have viscosities typically in a range of 50,000 to 10,000,000 centipoise. Additives can be colorants, lubricants, tackifiers, catalysts, and other low viscosity materials, that is, having viscosities in the range of 1 to 1,000 centipoise. It is often required to accomplish this mixing task in a continuous or in-line fashion using static or motionless mixing devices.

As a general design principle, prior distribution heads, such as those of U.S. Pat. No. 4,808,007 attempt to enhance the mixing process by increasing the interfacial area and reduce the interfacial thickness between two components to be mixed. This substantially improves molecular diffusion between the two components and, therefore, the mixing efficiency of any total mixing system. However, the present invention differs from the prior art in that good distribution and dispersion are developed between the components to be mixed prior to their being commingled as a fluid stream within the conduit.

Figure 1:
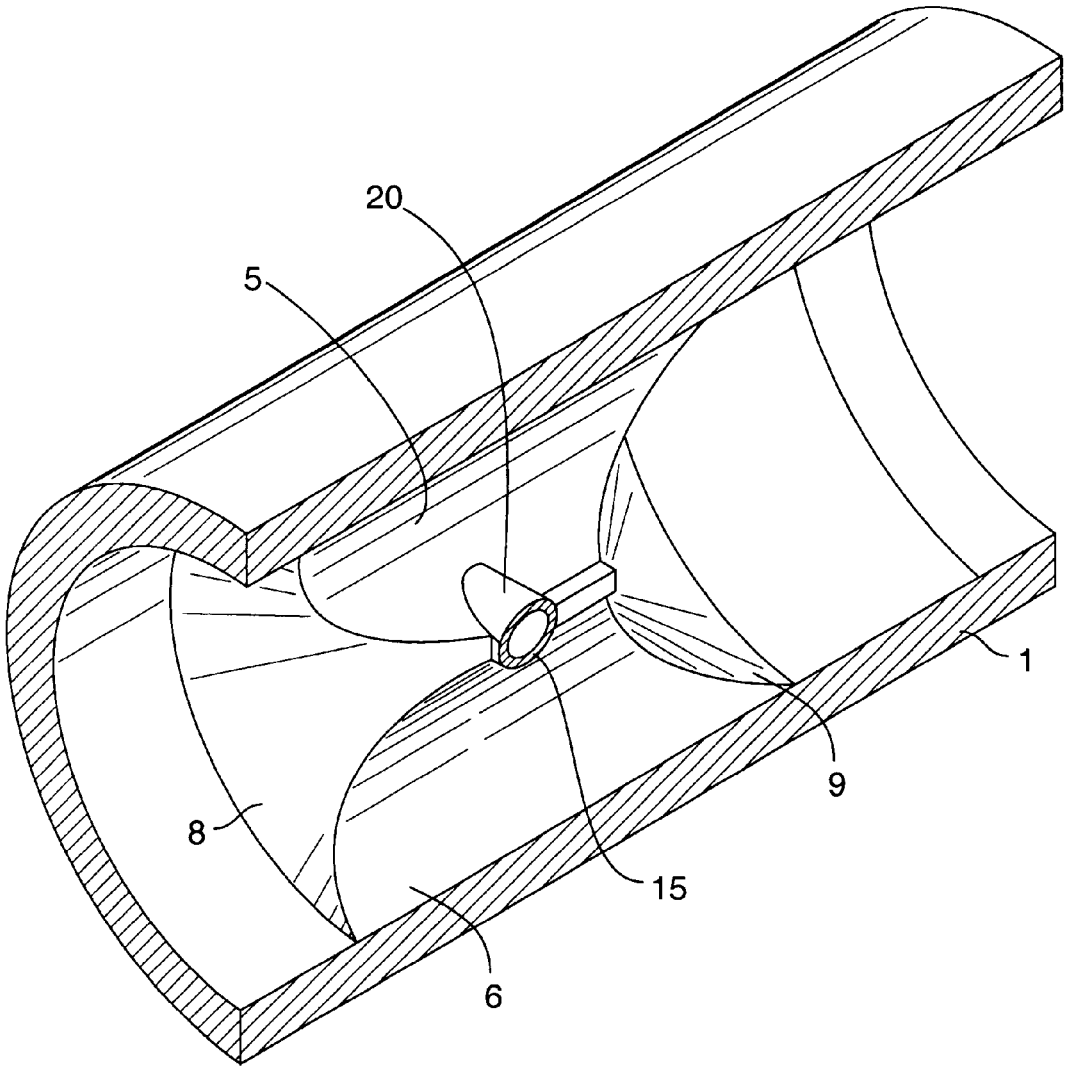
FIG. 1 PRIOR ART
FIG. 1 is an isometric representation of the prior art.
Figure 2:
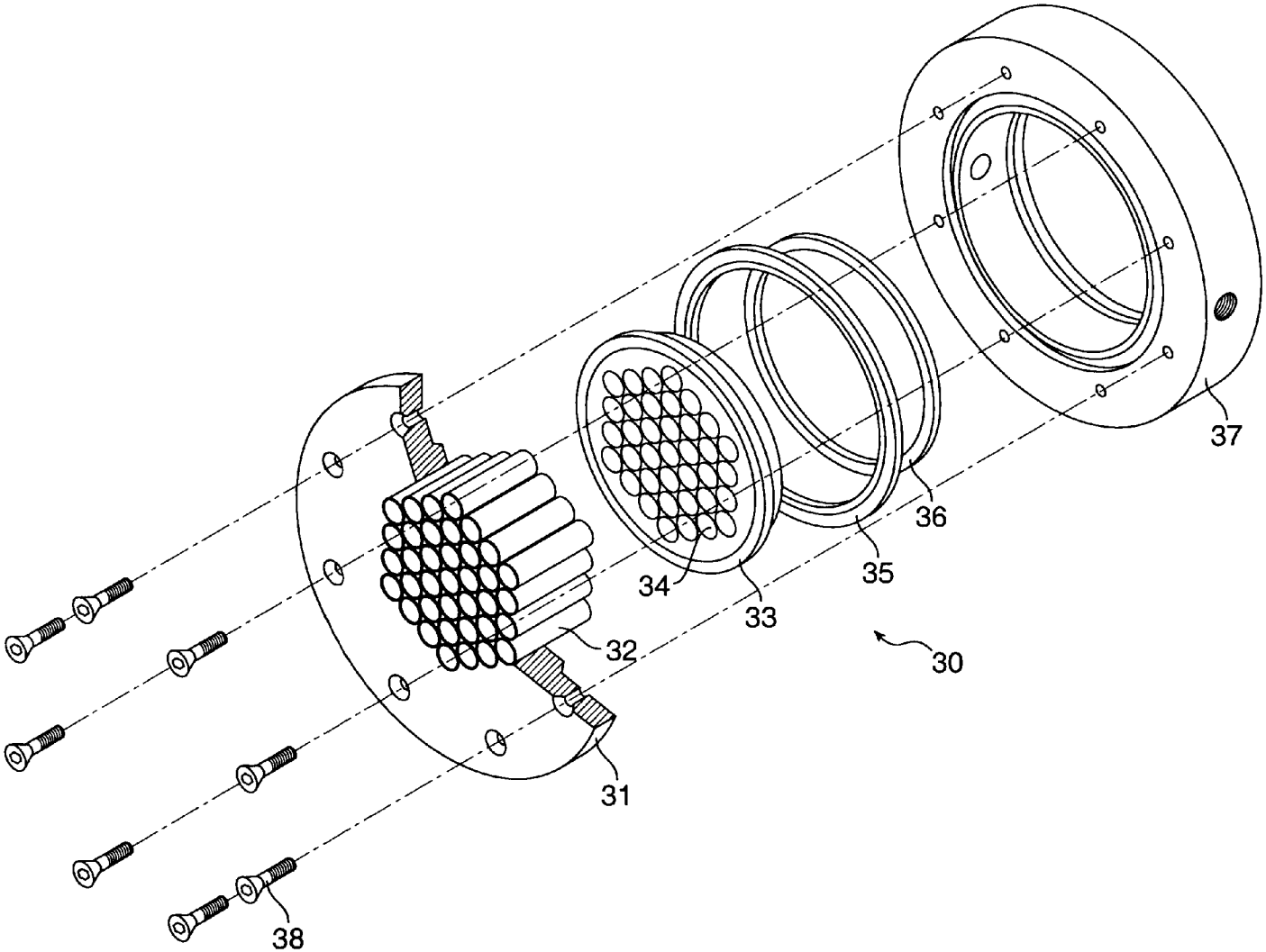
FIG. 2 is an exploded perspective view of the component parts making up the present invention.

Turning to FIG. 2, stationary material mixing apparatus 30 is shown in an exploded view. When the component parts are assembled, a baffle is created which is intended to be housed within a conduit (not shown) occupying the full cross-sectional area of the conduit.

It is noted, by again referring to FIG. 2, that stationary material mixing apparatus 30 is composed of tapped plate 31 which, together with disk 33 provides a port for a plurality of coplanar passageways, in this instance, in the forms of passageways 32. It is noted that passageways 32, each have a circular cross-section and longitudinal axis which generally parallels the longitudinal axis of stationary material mixing apparatus 30 and of the conduit in which it is housed. O-rings 35 and 36 seal the engagement between element 33 and barrel 37, the component parts being joined by screws 38 which pass through taps within plate 31 and barrel 37.

Figure 3:
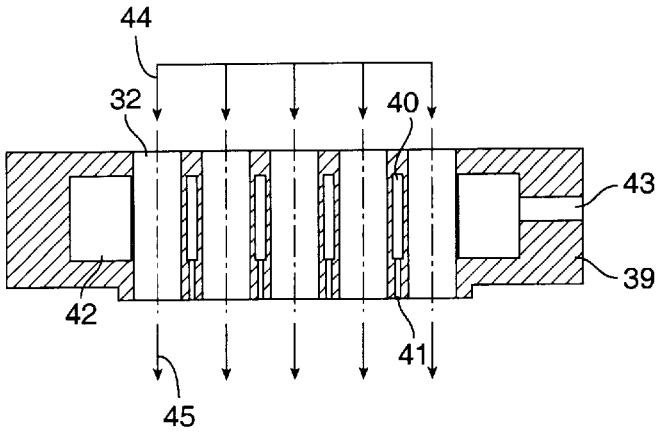
FIG. 3 is a cross-sectional view depicting the present invention.

As noted previously, the stationary material mixing apparatus of the present invention is provided for mixing relatively small quantities of additive fluid, generally of a low viscosity, to a main fluid flowing within a conduit, the main fluid generally having relatively high viscosities. In this regard, reference is made to FIG. 3 which shows a simplified view of the stationary material mixing apparatus of the present invention in cross-section. In this regard, the main fluid passing within the conduit enters the stationary material mixing apparatus at 44 into coplanar passageways 32. Additive fluid ports 40 are created within plate 31 whereby additive fluid enters the apparatus at bore 43 of body 39. Even distribution of additive fluid 43 to additive fluid ports 40 is insured by creating a racetrack 42 for accepting and acting as a reservoir for the additive fluid which is fed to additive fluid ports by passageways leading from racetrack 42 to additive fluid ports 40 established within barrel 39. In this regard, additive fluid exits passageways 41 coplanar with passageways 32 whereupon the low viscosity additive is combined with main fluid flowing within passageways 32 downstream of the stationary material mixing apparatus at 45.

Figure 4:
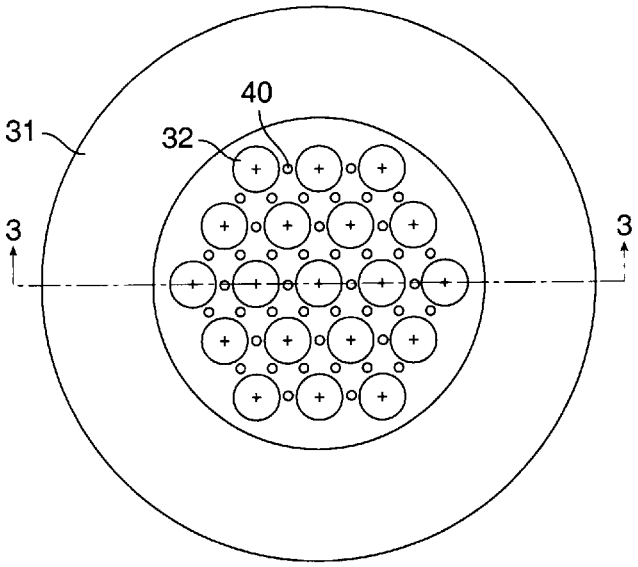
FIG. 4 is a diagrammatic view of the geometry of the present invention.

It is critical in practicing the present invention that additive fluid ports 40 be located at mid-circle points between adjacent passageways 32. As shown in FIG. 4A, the mid-circle point 60 between two adjacent passageways 32, having the same diameter "D", is the midpoint of a line 62 that joins the center points 64, 66 of the adjacent passageways 32.

Turning now to FIG. 4B, when additive fluid ports 40 are located at the mid-circle points between adjacent passageways 32, any particular passageway 32' can have as many as twelve additive fluid ports 40' and six adjacent passageways 32" surrounding it all coplanar with one another. In other words, a central passageway 32' can be surrounded by a concentric array of passageways 32" and an array of additive fluid ports 40'. The additive fluid ports 40' are located at mid-circle points between adjacent concentric array passageways 32" and at mid-circle points between the central passageway 32' and each concentric array passageway 32".

Figure 5:
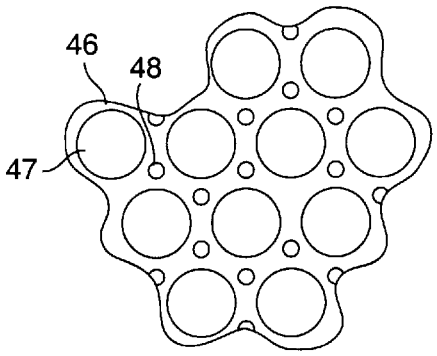
FIG. 5 is a downstream end view of a possible geometry which is not the present invention but which is included herein for comparative purposes.

This geometry should be compared with that shown in FIG. 5 whereby plate 46 is shown as being characterized as having large holes 47 for housing passageways 32 of FIGS. 4A and 4B and smaller holes 48 which are akin to additive fluid ports 40 shown in FIG. 4B. As noted below, the geometry shown in FIG. 5 does not adequately accomplish the intended mixing function to the degree of proficiency of the present invention. In other words, because additive inlet ports 48 are not located at the mid-circle points 60 between passageways 47, the apparatus of FIG. 5 is not capable of performing the mixing of a low viscosity additive to a main high viscosity fluid stream to the level achievable in practicing the present invention.

Figure 7:
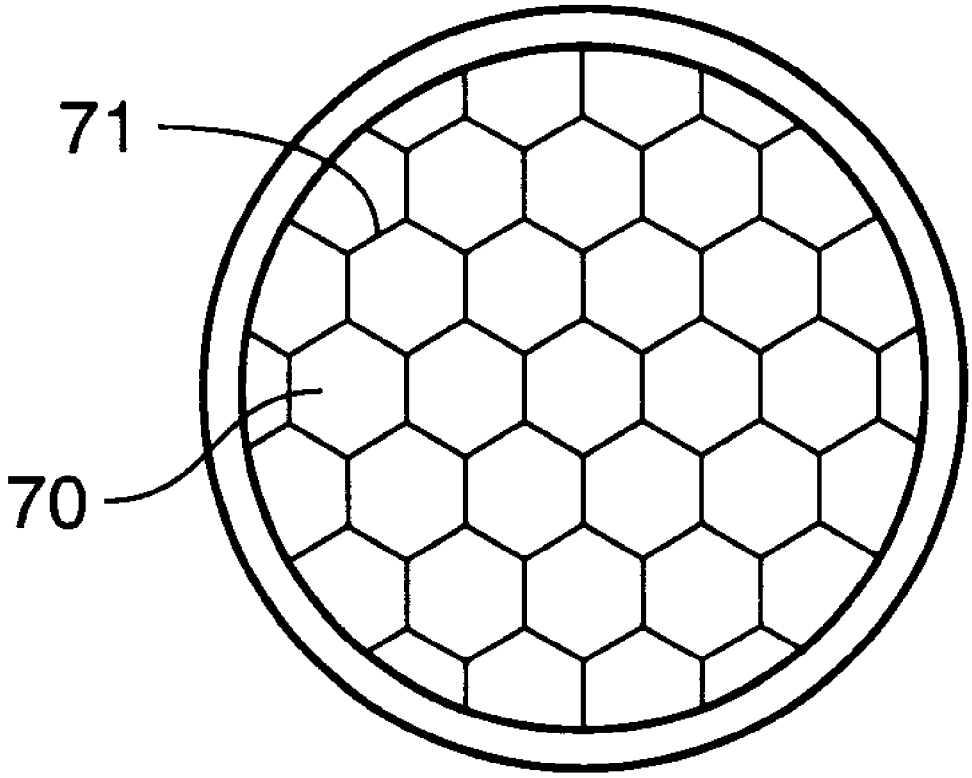
FIG. 7 is a front plan view showing the geometry of fluids as they emanate from the mixing device of the present invention.

In considering the uniqueness of the present invention, one might visualize a plate covering the diameter of a pipe with many identical and equally spaced circular holes distributed over the plate's surface. If one was to pump viscous material through the plate, it would be extruded as many identical circular streams or sausages. If a down stream flow restriction was then to be applied, all of the streams of sausages would be squeezed together to fill the pipe. Each stream would thus be forced to assume a hexagon shape. As shown in FIG. 7, the pattern produced across the diameter of the pipe would be identical to the honeycomb pattern produced by bees; the background fluid 70 being the high viscosity component emanating from passageways 32 and the honeycomb pattern 71 being the low viscosity component emanating from ports 40. If a low viscosity additive was to be added at those points where the main product flows are nearly tangential, each pair of main product flow squeezes its additive flow into a thin sheet. The overall result is to force the additive into a honeycomb pattern as well. It is upon this principle that the present invention relies.

It is noted that in practicing the present invention, a good deal of fluid stream mixing occurs prior to the actual engagement between the main fluid stream emanating from passageways 32 and additive emanating from coplanar fluid ports 40. In other words, the additive fluid emanating from additive fluid ports 40 is well dispersed within main fluid emanating from passageways 32 immediately upon the exit from the device of the present invention. As such, in the event that the various fluids react, a reaction takes place only after the various fluids emanate from the mixing apparatus of the present invention and reaction further only takes place after significant mixing has been carried out. In summary, the two fluid components passing through the stationary material mixing apparatus of the present invention emanate from the invention in parallel streams and a high degree of distribution is created before the streams meet creating a large interfacial area before these various streams enter any optionally provided downstream mixing equipment.

Figure 6:
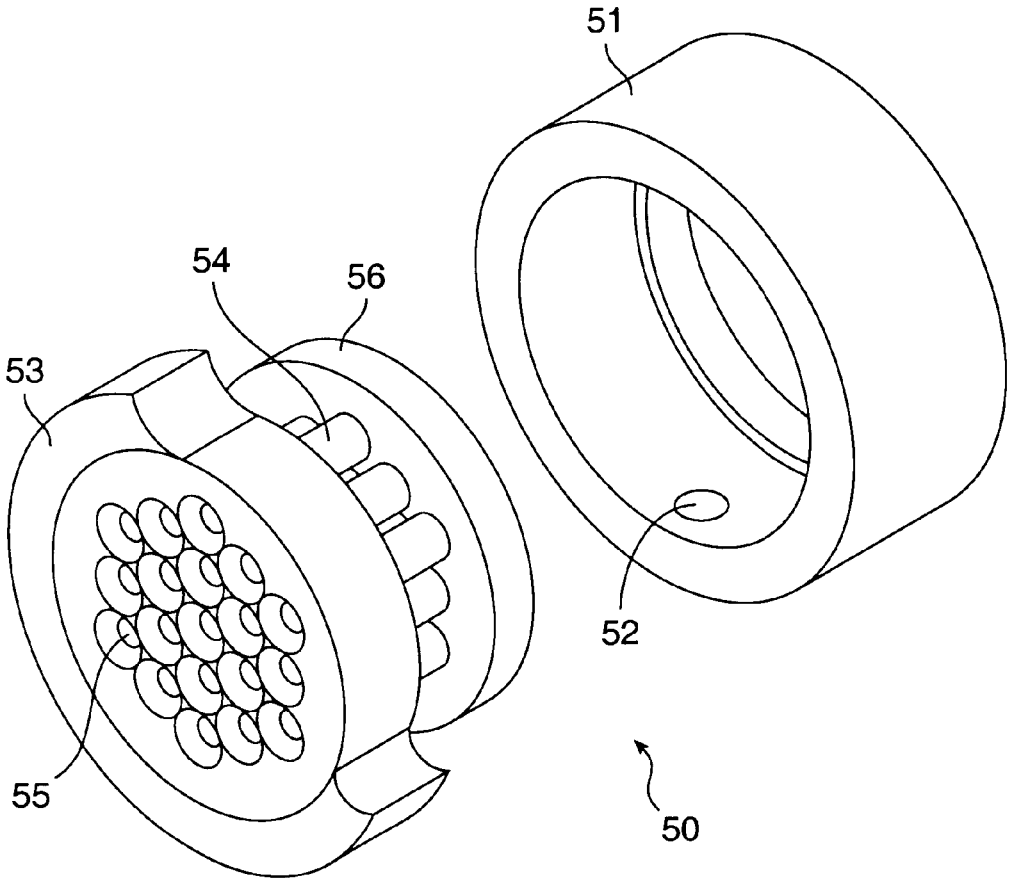
FIG. 6 is an isometric representation of an alternative configuration of the present invention.

As an alternative, reference is made to FIG. 6 depicting material mixing apparatus 50 composed of tapped plate 53 which, together with plate 56 provide support for passageways 54 each having a cross-section and longitudinal axis which generally parallels the longitudinal axis of stationary material mixing apparatus 50 and of the conduit in which it is housed (not shown).

Material mixing apparatus 50 is composed of two major components, namely, housing for passageways 54 and barrel 51. It is further noted that barrel 51 contains port 52 for admitting low viscosity additive through passageways 55 to a main fluid flowing within a conduit, the main fluid generally having relative high viscosities. Although not shown, it is noted that plate 53 and barrel 51 can be maintained by using a high temperature silicon while larger units can be sealed by use of metal "O" rings.

The device of the present invention also facilitates mixing by promoting heat exchange between the hot viscous polymer and cold additive. It is noted that a mistake that is oftemtimes made is to try to inject an additive at room temperature into a polymer at high temperature. Simple calculations show that very little heating occurs en route through the equipment barrel. Coming from a typical room temperature of 65°–70° F., the additive warms through the barrel to the order of 100°–150° F. This should be contrasted to the polymer temperature in the conduit which is generally maintained in the order of 350°–450° F. When the additive is injected into the high temperature polymer, localized chilling occurs. As an example, when the hot polymer has a viscosity of, for example, $10^6$ cP, the viscosity soars to a much higher value as a result of localized cooling. However, in light of the fact that the additive, in practicing the present invention, travels down separate tubular members, heat exchange between the polymer and additive is efficiently made so that by the time the polymer reaches its point of mixing with the additive, the additive is at or near the melt polymer temperature. This greatly facilitates the mixing application, an attribute not enjoyed by prior art devices.

In an attempt to quantify the present mixing operation, it is noted that the effective diameter of each stream passing through passageway 32 is $D/N^{0.5}$ wherein D=inside diameter of the conduit N=the number of passageways 32 for carrying the main flow component The total circumference of the main flow stream is established by the equation $N\pi D/N^{0.5}=N^{0.5}\pi D$ which is equal to the area per unit length of the main flow streams.

It is further noted that $tN^{0.5}\pi D=F\pi D^2/4$, that is, the interfacial thickness $t=FD/4N^{0.5}$ where F is the additive fraction. As such, the, ratio of interfacial area to interfacial thickness, $A/t=2\times N^{0.5}\pi D\times 4N^{0.5}/FD=8\pi N/F$.

As an illustration, assume that 1% of an additive is to be mixed to a high viscosity main fluid flow. If the present invention is provided with 19 passageways for carrying the main flow component, each having a diameter of 0.37 inches and 42 additive holes each being 0.007 inches in diameter installed in a 2½" inside diameter pipe, then the ratio of interfacial area to interfacial thickness is $8\pi\times 19/0.1=47{,}752$.

Although a good deal of discretion can be exercised in establishing the relative sizes of passageways 32 and coplanar additive ports 40, it is generally considered that in practicing the present invention, there be at least a 10:1 difference in size to achieve the benefits outlined above. Otherwise, it should be understood that various modifications within the scope of this invention can be made by one of ordinary skill in the art without departing from the spirit thereof. As such, the invention is to be defined by the scope of the appended claims as broadly as the prior art will permit, and in view of the specification.

I claim:

1. A stationary material mixing apparatus located within a conduit having a length, cross-section and longitudinal axis, the stationary material mixing apparatus being provided for mixing a relatively small quantity of a low viscosity additive fluid to a main high viscosity fluid flowing within the conduit, the stationary material mixing apparatus comprising:

a baffle extending throughout the conduit cross-section, the baffle having:

a plurality of coplanar passageways extending through the baffle, each passageway having a substantially circular cross-section and a longitudinal axis that is substantially parallel to the longitudinal axis of the conduit, the substantially circular cross-section of each passageway defining mid-circle points with the substantially circular cross-sections of adjacent passageways;

a plurality of coplanar additive fluid ports extending into the baffle, each additive fluid port only located at one of the mid-circle points; and a fluid path established within the baffle for feeding the additive fluid to the plurality of additive fluid ports for mixing with the main fluid flowing within the conduit.

2. The apparatus of claim 1 wherein the cross-section of each additive fluid port is smaller than the cross-section of each passageway.

3. The apparatus of claim 2 wherein the cross-section of each additive fluid port is 10 times smaller than the cross-section of each passageway.

4. A stationary material mixing apparatus located within a conduit having a length, cross-section and longitudinal axis, the stationary material mixing apparatus being provided for mixing a relatively small quantity of low viscosity additive fluid to a main high viscositiy fluid flowing within the conduit, the stationary material mixing apparatus comprising:

a baffle extending throughout the conduit cross-section, the baffle having:

a central passageway extending through the baffle, the central passageway having a substantially circular cross-section and having a longitudinal axis substantially parallel to the longitudinal axis of the conduit;

an array of coplanar passageways extending through the baffle, the array of passageways being concentric and coplanar with the central passageway, each array passageway having a substantially circular cross-section that is substantially equal in diameter to the circular cross-section of the central passageway, each array passageway having a longitudinal axis that is substantially parallel to the longitudinal axis of the conduit, the substantially circular cross-sections of adjacent array passageways, and array passageways adjacent to the central passageway, defining mid-circle points;

a plurality of coplanar additive fluid ports extending into the baffle, each additive fluid port only located at one of the mid-circle points; and a fluid path established within the baffle for feeding the additive fluid to the plurality of additive fluid ports for mixing with the main fluid flowing within the conduit.

5. The apparatus of claim 4 wherein the cross-section of each additive fluid port is smaller than the cross-section of each passageway.

6. The apparatus of claim 5 wherein the cross-section of each additive fluid port is 10 times smaller than the cross-section of each passageway.

7. A stationary material mixing apparatus located within a conduit having a length, cross-section and longitudinal axis, the stationary material mixing apparatus being provided for mixing a relatively small quantity of a low viscosity additive fluid to a main high viscosity fluid flowing within the conduit, the stationary material mixing apparatus consisting essentially of:

a baffle extending throughout the conduit cross-section, the baffle having:

a plurality of coplanar passageways extending through the baffle, each passageway having a substantially circular cross-section and a longitudinal axis that is substantially parallel to the longitudinal axis of the conduit, the substantially circular cross-section of each passageway defining mid-circle points with the substantially circular cross-sections of adjacent passageways;

a plurality of coplanar additive fluid ports extending into the baffle, each additive fluid port only located at one of the mid-circle points; and a fluid path established within the baffle for feeding the additive fluid to the plurality of additive fluid ports for mixing with the main fluid flowing within the conduit.

8. The apparatus of claim 7 wherein the cross-section of each additive fluid port is smaller than the cross-section of each passageway.

9. The apparatus of claim 8 wherein the cross-section of each additive fluid port is 10 times smaller than the cross-section of each passageway.

10. A method of mixing a low viscosity additive fluid into a high viscosity main fluid flowing within a conduit the conduit having a length, cross-section and a longitudinal axis, the method comprising the steps of:

providing a baffle that extends across the cross-section of the conduit;

providing a plurality of coplanar passageways that extend through the baffle, each passageway having a substantially circular cross-section that is substantially equal in diameter to the substantially circular cross-section of an adjacent passageway;

arranging the plurality of passageways so that mid-circle points are established between adjacent passageways;

providing a plurality of coplanar additive fluid ports that extend into the baffle;

arranging the plurality of additive fluid ports so that an additive fluid port is only located at each mid-circle point;

establishing a fluid path within the baffle for feeding additive fluid to the plurality of additive fluid ports; and feeding said high viscosity main fluid through said passageways and feeding said low viscosity additive fluid through said additive fluid ports for mixing said main fluid with said additive fluid.

11. The method of claim 10, further comprising the steps of:

commencing a flow of the additive fluid through the plurality of additive fluid ports; and commencing a flow of the main fluid after the flow of the additive fluid has commenced.

12. A method of mixing a low viscosity additive fluid into a high viscosity main fluid flowing within a conduit the conduit having a length, cross-section and a longitudinal axis, the method comprising the steps of:

providing a baffle that extends across the cross-section of the conduit;

providing a central passageway that extends through the baffle, the central passageway having a substantially circular cross-section and having a longitudinal axis that is substantially parallel to the longitudinal axis of the conduit;

providing a coplanar array of passageways that extend through the baffle, each array passageway having a substantially circular cross-section that is substantially equal in diameter to and coplanar with the substantially circular cross-section of the central passageway;

arranging the array of passageways so that the array of passageways are concentric with the central passageway and mid-circle points are established between adjacent array passageways and between array passageways adjacent with the central passageway;

providing a plurality of coplanar additive fluid ports that extend into the baffle;

arranging the plurality of additive fluid ports so that an additive fluid port is only located at each mid-circle point;

establishing a fluid path within the baffle for feeding additive fluid to the plurality of additive fluid ports; and feeding said high viscosity main fluid through said passageways and feeding said low viscosity additive fluid through said additive fluid ports for mixing said main fluid with said additive fluid.

13. The method of claim 12, further comprising the steps of:

commencing a flow of the additive fluid through the plurality of additive fluid ports; and commencing a flow of the main fluid after the flow of the additive fluid has commenced.

14. A method of mixing a low viscosity additive fluid into a high viscosity main fluid flowing within a conduit the conduit having a length, cross-section and a longitudinal axis, the method consisting essentially of the steps of:

providing a baffle that extends across the cross-section of the conduit;

providing a plurality of coplanar passageways that extend through the baffle;

arranging the plurality of passageways so that mid-circle points are established between adjacent passageways;

providing a plurality of additive fluid ports coplanar with themselves and with said passageways that extend into the baffle;

arranging the plurality of additive fluid ports so that an additive fluid port is only located at each mid-circle point;

establishing a fluid path within the baffle for feeding additive fluid to the plurality of additive fluid ports; and feeding said high viscosity main fluid through said passageways and feeding said low viscosity additive fluid through said additive fluid ports for mixing said main fluid with said additive fluid.

15. The method of claim 14, further consisting essentially of the steps of:

commencing a flow of the additive fluid through the plurality of additive fluid ports; and commencing a flow of the main fluid after the flow of the additive fluid has commenced.

* * * * *